US005295766A

United States Patent [19]

Tiikkainen

[11] Patent Number: 5,295,766

[45] Date of Patent: Mar. 22, 1994

[54] APPARATUS AND METHOD FOR BUILDING A FOUNDATION FOR UPRIGHTS OR FOR MAKING PASSAGES THERETHROUGH

[76] Inventor: Matti K. Tiikkainen, Väinöläntie 24, SF-01900 Nurmijärvi, Finland

[21] Appl. No.: 924,061

[22] PCT Filed: Feb. 25, 1991

[86] PCT No.: PCT/FI91/00058

§ 371 Date: Sep. 21, 1992

§ 102(e) Date: Sep. 21, 1992

[87] PCT Pub. No.: WO91/13225

PCT Pub. Date: Sep. 5, 1991

[30] Foreign Application Priority Data

Feb. 28, 1990 [FI] Finland ..... 901002

[51] Int. Cl.[5] ..... E21B 7/26; E04H 12/22; E02D 13/00

[52] U.S. Cl. ..... 405/232; 405/244; 405/258; 52/157

[58] Field of Search ..... 405/244, 259.1, 303, 405/232, 231, 229, 230; 52/157; 248/156, 545

[56] References Cited

U.S. PATENT DOCUMENTS

| | | | |
|---|---|---|---|
| 299,770 | 6/1884 | Fischer | 52/157 |
| 2,643,843 | 6/1953 | Brown | 52/157 X |
| 3,318,058 | 5/1967 | Sullivan | 52/157 |
| 4,162,789 | 7/1979 | Hollaway | 52/157 X |
| 4,251,963 | 2/1981 | Patterson | 52/157 |
| 4,316,350 | 2/1982 | Watson | 52/157 |
| 4,923,165 | 5/1990 | Cockman | 248/545 |
| 5,139,235 | 8/1992 | Kilmer | 52/157 X |

FOREIGN PATENT DOCUMENTS

| | | |
|---|---|---|
| 380043 | 3/1986 | Austria . |
| 0073264 | 3/1983 | European Pat. Off. . |
| 652831 | 1/1938 | Fed. Rep. of Germany . |
| 1098452 | 1/1961 | Fed. Rep. of Germany . |
| 1157162 | 11/1963 | Fed. Rep. of Germany . |
| 2249281 | 4/1974 | Fed. Rep. of Germany . |
| 2422489 | 11/1975 | Fed. Rep. of Germany . |
| 31378 | 5/1961 | Finland . |
| 2082152 | 12/1971 | France . |
| 445816 | 3/1968 | Sweden . |
| 1048151 | 11/1966 | United Kingdom . |

*Primary Examiner*—Dennis L. Taylor
*Attorney, Agent, or Firm*—Hill, Steadman & Simpson

[57] ABSTRACT

An apparatus and a method for building a foundation for uprights, such as flagpoles, posts, pillars or the like, or for making passages e.g. for cables, tubes etc. The apparatus (1) includes a drive-shaft (3) equipped helical auger (2). The shaft (3) is provided with a tubular body portion (4,4*a*). The end of the body section (4*a*) facing the helical auger (2) is fitted with a conical section (5) tapering towards helical auger (2). Thus, when the apparatus is in operation, the tapered section (5) serves to compact a soil layer softened by the helical auger (2).

14 Claims, 2 Drawing Sheets

APPARATUS AND METHOD FOR BUILDING A FOUNDATION FOR UPRIGHTS OR FOR MAKING PASSAGES THERETHROUGH

BACKGROUND OF THE INVENTION

The present invention relates to an apparatus and a method for building a foundation, particularly a frost-resistant foundation, for uprights such as flagpoles, posts, pillars or the like or for making passages therethrough e.g. for cables, tubes etc., said apparatus comprising a drive-shaft equipped helical auger, said shaft being provided with a tubular body portion, the helical auger having a substantially larger diameter than the body portion.

At present, the upright foundations are generally built by digging a hole in the ground, by setting a concrete pipe in the hole and by casting grippers or a self-erectable assembly in the concrete pipe. This type of method is relatively tedious and, in addition, causes disturbances in the environment e.g. when the installation is made on a lawn, due to the necessity of digging a sufficiently large erection hole. The passages are presently made by using e.g. percussion drilling, pressure drilling as well as ramming. One drawback in these methods is a relatively high power demand of the equipment used therein.

SUMMARY OF THE INVENTION

An object of the invention is to provide a relatively simple and expedient method and apparatus for facilitating the building of a foundation for uprights, said apparatus and method being also applicable for fixing various objects to the bottoms of waterways. Another object is to provide an apparatus and a method for making various passages e.g. for passing under traffic routes.

The objects of the present invention are achieved by an apparatus for building a frost-resistant foundation for uprights, such as flagpoles, posts, pillars etc., or for making passages e.g. for cables, tubes etc., wherein the apparatus has a drive-shaft equipped helical auger. The shaft is fitted with a tubular body portion and the diameter of the helical auger is substantially larger than that of the body portion. An end of a body section facing the helical auger is fitted with a conical section tapering towards the helical auger whereby, when the apparatus is in operation, the tapered section compacts the soil layer that is softened by the helical auger.

The following are advantageous developments of the apparatus of the present invention. The body section is fixedly mounted on the drive shaft. The body portion includes two sections in a manner that a leading body section is fixedly mounted on the drive shaft while a remaining body section is mounted in the freely rotatable fashion relative to leading body section. The remaining body section is made of a thin sheet metal, plastic or a like so as to serve as a tubular mould for a foundation or as a passage conduit. The remaining body section comprises a pipeline to be passed through. The body portion is mounted in a freely rotatable fashion on the drive shaft, the apparatus being operated by rotating the drive shaft. The body portion is adapted to include at least two sections, the sections being coupled together by means of an internal connecting sleeve.

The magnitude of the coming angle $\alpha$ of the tapered section is within the range of circa 25–5020, preferably circa 30–45°.

The length of the tapered section is at least equal to the pitch of helical auger, the volume of earth material compacted by tapered section being at least equal to that of earth material displaced by the helical auger during the course of a single rotation.

The tapered section originates substantially at the level of the top edge of the helical auger.

The ratio of the external diameter of the body portion to that of the drive shaft is circa 1.5–10:1, preferably circa 2–8:1.

The apparatus of the present invention can be used as a mooring apparatus for objects to be anchored on or below the surface of a waterway.

The present invention is also a method for building a frost-resistant foundation for uprights, such as flagpoles, posts, pillars and the like, the method using an apparatus which includes a drive-shaft equipped helical auger, the shaft being provided with a tubular body portion. The end of a body section having the helical auger in the apparatus used in the method is fitted with a tapered or conical section which tapers towards helical auger. The method includes driving the apparatus to a desired depth in the soil material by rotating the drive shaft, the tapered section serving to compact the softened soil layer penetrated by the helical auger. The method further includes a step of filling with concrete a tubular section of the apparatus driven into earth material and/or a conduit formed in earth material by the apparatus.

The present invention is also a method for making passages e.g. for cables, tubes for the like, the method employing an apparatus having a drive-shaft equipped helical auger, the shaft being provided with a tubular body portion. The end of a body section facing the helical auger in the apparatus used in the method is fitted with a conical section which tapers towards the helical auger. The method includes a step of driving the apparatus through a soil layer to be penetrated by rotating the drive shaft, the tapered section serving to compact the softened soil layer penetrated by the helical auger and a step of partially removing the apparatus on the emerging side in a manner wherein the tubular section(s) remain in position for providing a passage or a pipeline, or completely, whereby the passage is formed by a compacted conduit created by the apparatus directly in earth material.

The most important benefit offered by an apparatus and a method of the invention is that the tapered leading end of a body portion achieves the compaction of the earth material penetrated by a helical auger, thus providing an improved base for a foundation or a passage.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawing, and in which:

DESCRIPTION OF THE PREFERRED EMBODIMENT

Figure 1:
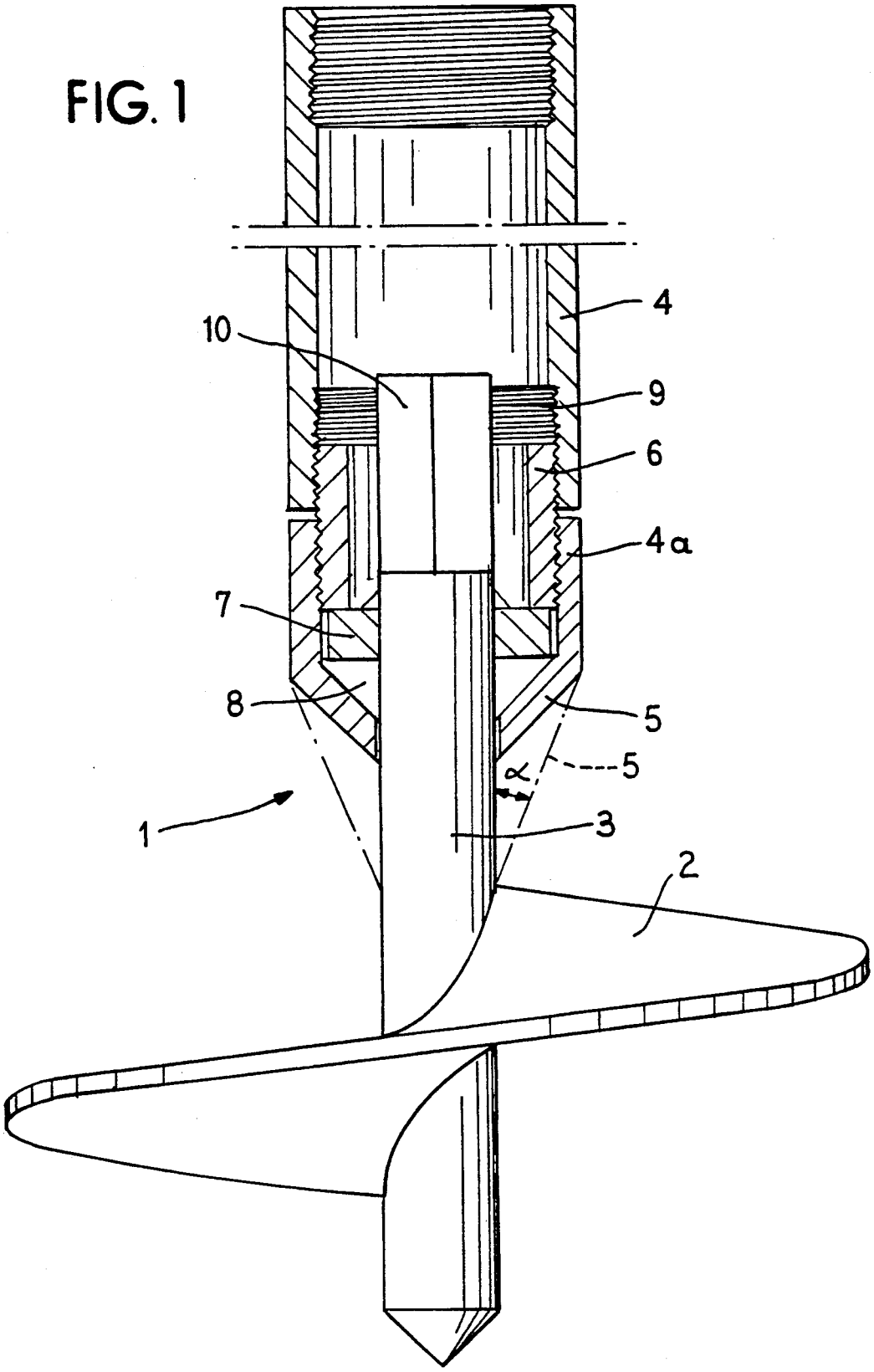
FIG. 1 shows a lateral and sectional view of one embodiment for an apparatus of the invention.
Figure 2:
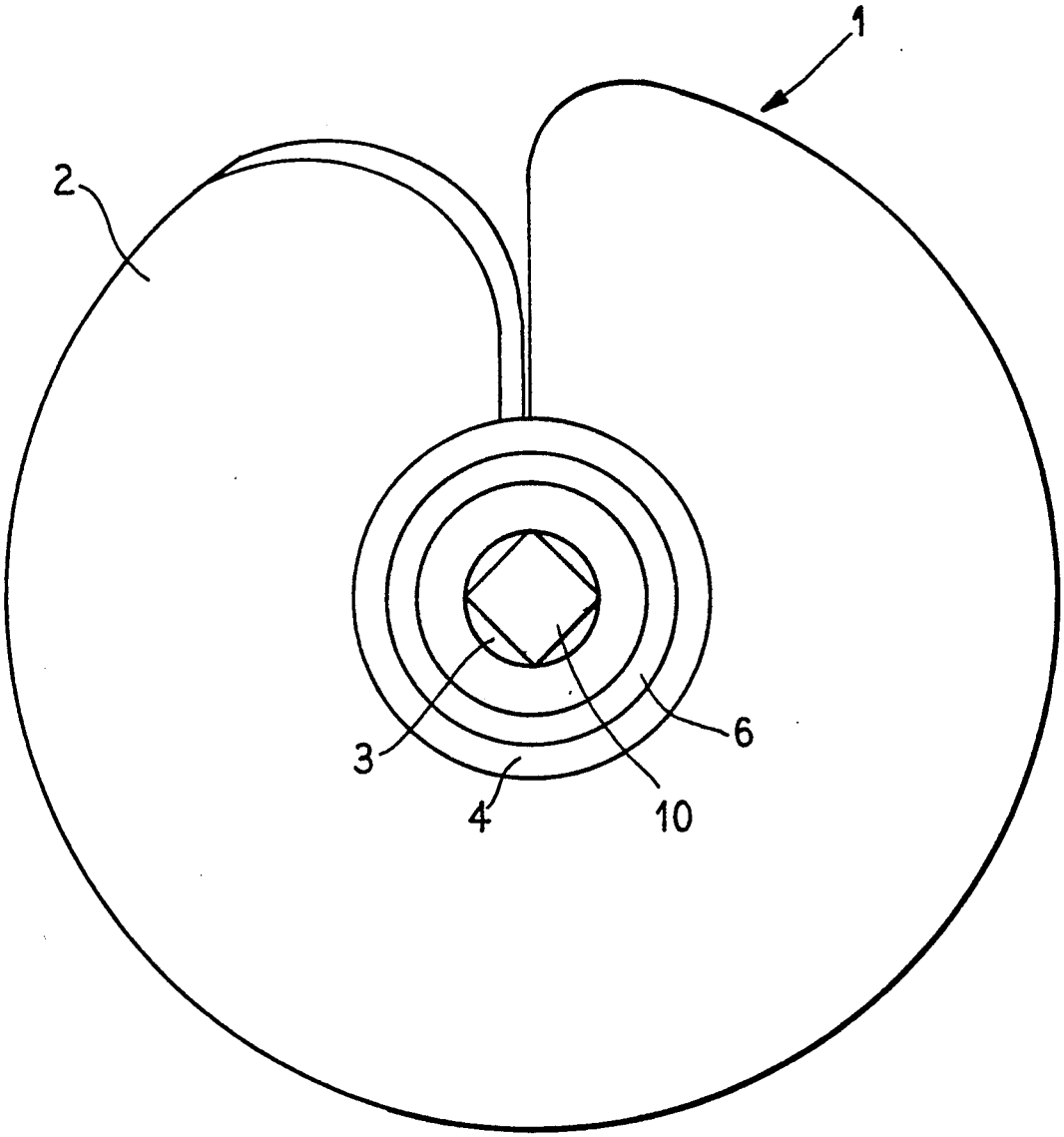
FIG. 2 is a plan view of the apparatus shown in FIG. 1.

According to FIGS. 1 and 2, an apparatus of the invention includes a helical auger 2 which is provided with a drive shaft 3. The drive shaft 3 carries a tubular body portion , which in the illustrated embodiment includes two sections 4 and 4a. The end of a leading section 4a facing said helical auger 2 is provided with a conical section 5 tapering towards the helical auger 2, said tapered section achieving the compaction of a soil layer penetrated by the helical auger. The magnitude of a coning angle $\alpha$ of tapered section 5 is suitably within the range of circa 25–50° and preferably circa 30–45°. The length of tapered section 5 is preferably at least equal to the pitch of helical auger 2, whereby the volume of earth material compacted by tapered section is at least equal to that of earth material displaced by helical auger 2 during a single rotation. In view of compaction purposes, said tapered section 5 is located between helical auger 2 and body section 4a, whereby the apex of tapered section 5 facing said helical auger 2 is preferably substantially level with the top edge of helical auger 2, e.g. as shown with dash-dot-lines in FIG. 1, the earth material being compacted substantially over the entire length of the apparatus. In view of effective compaction, the ratio of the external diameter of tubular section 4a to that of the cylindrical section of drive shaft 3 is suitably within the range of circa 1.5–10:1, preferably circa 2–8:1.

The ratio of the diameter of helical auger 2 to the external diameter of body section 4a is at least appr. 1.8:1. Normally, the ratio is within the range of appr. 2:1—appr. 3:1. The upper limit depends primarily on the earth material and it can be multiple compared with the above-described values. On the other hand, the ratio between the diameter of helical auger 2 and that of drive shaft 3 at the plate section is at least circa 2.7:1, the optimum range being circa 10–12:1. The drive shaft is further fitted with a flange element 7 which is set on top of a component 8, the latter being fitted inside tubular section 4a and providing a bearing surface. The end 10 of drive shaft 3 facing body section 4a is preferably designed to be square-shaped for rotating said drive shaft 3 with an appropriate wrench, adapted for working inside tube 4. The end 10 of drive shaft 3 facing body section 4a can also be provided with other types of gripping means for a driving device, such means including e.g. an Allen key hole, a threaded hole, a square hole etc., wherein a complementary-shaped tool can be fitted for rotating the drive shaft inside the ends of body portion 4a and 4 coming against each other is preferably provided a threaded section 9 which carries a threaded connecting sleeve 6 for fastening said body sections 4a and 4 removably to each other. In addition, the end of body portion 4 facing away from said leading section 4a can be provided with a corresponding threading for extending the body portion to include a plurality of sections.

The body portion 4a, 4 can also be designed as an integral component, fixedly mounted on drive shaft 3, the apparatus thus being operated preferably by rotating the body portion.

The apparatus can also be designed e.g. in a manner that the leading section 4a of a body portion is fixedly mounted on drive shaft 3 while the remaining section 4 is made e.g. of a thin-walled sheet metal pipe, a plastic tube or a like, which can be used as a tubular mould when building a foundation.

When using the apparatus for building a foundation for uprights, said drive shaft 3 is rotated by means of appropriate driving mechanisms to a desired depth and, if necessary, the apparatus length is increased by including more tubular sections 4 in the apparatus by means of connecting sleeves 6 or like fastening elements. After reaching a desired depth, the driving mechanism can be removed or left in position, if desired. Thus, the apparatus can be used as a foundation as such, whereby a structure to be erected can be inserted directly inside tubular section 4 or it can be filled e.g. with cast concrete for building a more stable foundation, in which case the top portion of a foundation is usually provided with separate fastening elements for fixing a structure to be erected.

When operating at relatively low depths, e.g. appr. 0.5–2.5 m, it is possible to use an embodiment in which the body portion forms an integral unit with shaft 3, the apparatus being operable by rotating the body portion with appropriate mechanisms. This is well applicable e.g. to building foundations for fence posts.

In view of making a foundation frost-resistant, the upper portion of the apparatus can be provided e.g. with a suitable plate element which is tightened :n position so as to produce tension in a soil layer between helical auger 2 and a plate element. Generally, the freezing of earth produces a vacuum in the soil layer, said layer absorbing water from the deeper non-freezing layers. The above-described formation of tension in a soil layer prevents the absorption of water into said soil layer and, thus, the formation of so-called frost boils.

When using the apparatus for making passages, said drive shaft 3 is rotated with appropriate driving mechanisms until the apparatus comes into the sight e.g. on the other side of a road, if the question is about road underpasses. After the apparatus has come in sight on the opposite side, the apex section 4a can be removed in the illustrated embodiment and the remaining body section 4 can be left as such to serve as a cable conduit.

In order to provide a passage for various tubes, cables and the like it is also possible to employ such an embodiment, wherein said drive shaft 3 is only fitted with a short apex section 4a of the body portion whereby, when operating in a suitable soil material, the apparatus creates directly in the soil material a relatively tight-surfaced duct for tubes, cables and the like. This embodiment is also useful in building foundations, the duct being filled e.g. with concrete and a drive-shaft operating means, e.g. a rod or a wire cable, is preferably left in position inside cast concrete.

The above-described embodiments are only intended to show examples of a few preferred designs and applications for the apparatus and the method and there is no intention to limit the scope of protection defined in the annexed claims. The apparatus can be used e.g. :n place of a drilling pole and also as an anchoring device and erection method in the soil layer of the bottom of waterways, even at the depths of several hundred meters. In this context, it is essential that the installation can be effected from a vessel on the surface or even from the surface of frozen ice, the helical auger overcoming the levating force caused by ice, whereby this application is excellent e.g. as a pier post.

In the context of the present application it is used the term "helical auger" for the helical member 2. It should be noted that the helical member 2 is used mainly as a tool to pull the apparatus 1 into the ground as well as a load-bearing member and, therefore, the term helical auger could be replaced e.g. by one of the terms "helical blade, helical plate or helical flange" whichever is preferred.

The invention is not limited to the particular details of the apparatus and method depicted and other modifications and applications are contemplated. Certain other changes may be made in the above described apparatus and method without departing from the true spirit and scope of the invention herein involved. It is intended, therefore, that the subject matter in the above depiction shall be interpreted as illustrative and not in a limiting sense.

What is claimed is:

1. An apparatus for at least one of building a frost-resistant foundation for uprights and making passages, said apparatus comprising: a drive shaft equipped helical auger, which shaft is fitted with a tubular body portion, a diameter of said helical auger being substantially larger than a diameter of said body portion, a ratio of said diameter of said helical auger to said diameter of said tubular body portion being at least 1.8:1; said tubular body portion having at least a first body section, an end of said first body section of said tubular body portion facing said helical auger being fitted with a conical section tapering towards helical auger, an apex of said conical section being substantially level with a top edge of said helical auger, and a length of said conical section being at least equal to a pitch of said helical auger; whereby, when the apparatus is in operation, said tapered conical section compacts a soil layer softened by said helical auger, a volume of earth material compacted by said conical section being at least equal to a volume of earth material displaced by said helical auger during the course of a single rotation thereof.

2. The apparatus as set forth in claim 1, wherein said first body section is fixedly mounted on said drive shaft.

3. The apparatus as set forth in claim 2, wherein the body portion has first and second body sections, said first body section being a leading section and said second body section being a remaining body section, said leading section of said first and second sections being fixedly mounted on said drive shaft and said remaining body section of said first and second sections being mounted in a freely rotatable fashion relative to said leading section, said remaining section being made of a thin sheet material so as to serve as a tubular mould for a foundation or as a passage conduit.

4. The apparatus as set forth in claim 3, wherein said remaining section comprises a pipeline.

5. The apparatus as set forth in claim 1, wherein said body portion is mounted in a freely rotatable fashion on said drive shaft, the apparatus being operated by rotating said drive shaft.

6. The apparatus as set forth in claim 5, wherein said body portion has at least first and second sections, said first and second sections being coupled together by means of an internal connecting sleeve.

7. The apparatus as set forth in claim 1, wherein a magnitude of a conning angle $\alpha$ of said tapered conical section is in the range of 25° to 50°.

8. The apparatus as set forth in claim 1, wherein an external diameter of said body portion to an external diameter of said drive shaft is in the range of 1.5:1 to 10:1.

9. The apparatus as set forth in claim 1, wherein the apparatus is a mooring apparatus for objects to be anchored on or below a surface of a waterway.

10. A method for building a frost-resistant foundation for uprights, said method comprising the steps of: providing an apparatus which includes a drive shaft equipped helical auger, said shaft being provided with a tubular body portion, a ratio of said diameter of said helical auger to said diameter of said tubular body portion being at least 1.8:1; fitting an end of a body section of said tubular body portion facing said helical auger with a tapered conical section which tapers towards said helical auger, an apex of said conical section being substantially level with a top edge of said helical auger, and a length of said conical section being at least equal to a pitch of said helical auger; and driving said apparatus to a desired depth in a soil material by rotating said drive shaft, said tapered conical section serving to compact a softened soil layer penetrated by said helical auger, a volume of earth material compacted by said conical section being at least equal to a volume of earth material displaced by said helical auger during the course of a single rotation thereof.

11. The method as set forth in claim 10, wherein the method further includes a step of filling with concrete said tubular body portion.

12. A method for making passages, said method comprising the steps of: providing an apparatus having a drive shaft equipped helical auger, said shaft being provided with a tubular body portion having at least one tubular section, a ratio of said diameter of said helical auger to said diameter of said tubular body portion being at least 1.8:1; fitting an end of a body section of said tubular body portion facing said helical auger with a conical section which tapers towards said helical auger, an apex of said conical section being substantially level with atop edge of said helical auger, and a length of said conical section being at least equal to a pitch of said helical auger; driving said apparatus through a soil layer to be penetrated by rotating said drive shaft, said tapered conical section serving to compact a softened soil layer penetrated by said helical auger; and at least partially removing said apparatus on an emerging side such that said at least one tubular section remains in position for providing a passage, and when said apparatus is completely removed, the passage is formed by a compacted conduit directly in earth material.

13. The apparatus as set forth in claim 7, wherein the magnitude of the conning angle $\alpha$ of said tapered conical section is in the range of 30° to 45°.

14. The apparatus as set forth in claim 8, wherein the ratio is in the range of 2:1 to 8:1.

* * * * *